US007216838B1

(12) United States Patent
Gretz

(10) Patent No.: US 7,216,838 B1
(45) Date of Patent: May 15, 2007

(54) ADJUSTABLE BAR FOR CATHEDRAL MOUNT CEILING BOX

(75) Inventor: Thomas J. Gretz, Clarks Summit, PA (US)

(73) Assignee: Arlington Industries, Inc., Scranton, PA (US)

( * ) Notice: Subject to any disclaimer, the term of this patent is extended or adjusted under 35 U.S.C. 154(b) by 86 days.

(21) Appl. No.: 11/215,859

(22) Filed: Aug. 31, 2005

(51) Int. Cl.
*E04G 25/00* (2006.01)

(52) U.S. Cl. ..... 248/200.1; 52/745.2; 248/343; 248/906

(58) Field of Classification Search ..... 248/200.1, 248/342, 343, 344, 906; 174/54; 220/3.9; 52/745.2

See application file for complete search history.

(56) References Cited

U.S. PATENT DOCUMENTS

| | | | | |
|---|---|---|---|---|
| 4,538,786 | A | 9/1985 | Manning | |
| 5,303,894 | A * | 4/1994 | Deschamps et al. | 248/343 |
| 5,503,359 | A | 4/1996 | Patterson | |
| 5,505,419 | A * | 4/1996 | Gabrius | 248/343 |
| 5,522,577 | A | 6/1996 | Roesch | |
| 5,592,788 | A | 1/1997 | Corridon | |
| 5,806,269 | A | 9/1998 | Corridon | |
| 5,957,574 | A * | 9/1999 | Hentz et al. | 248/343 |
| 6,098,945 | A * | 8/2000 | Korcz | 248/343 |
| 6,889,943 | B2 * | 5/2005 | Dinh et al. | 248/343 |
| 6,967,284 | B1 * | 11/2005 | Gretz | 174/58 |
| 2003/0006353 | A1 * | 1/2003 | Dinh et al. | 248/343 |
| 2006/0243877 | A1 * | 11/2006 | Rippel | 248/343 |
| 2006/0261235 | A1 * | 11/2006 | Rippel et al. | 248/343 |

* cited by examiner

*Primary Examiner*—Ramon O Ramirez

(57) ABSTRACT

An adjustable mounting assembly for hanging a light fixture, fan, or other electrical device from a cathedral ceiling. The adjustable mounting assembly allows an installer to easily mount an electrical device in any location along the apex of a cathedral ceiling. The adjustable mounting assembly includes a central bracket, adjustable mounting bars, and an arrangement for securing an electrical box to the assembly. All the hardware required for securing the mounting assembly to the rafters and for securing the electrical device thereto is included with the assembly for easily accessibility by the installer.

16 Claims, 9 Drawing Sheets

ADJUSTABLE BAR FOR CATHEDRAL MOUNT CEILING BOX

FIELD OF THE INVENTION

This invention relates to mounting assemblies for electrical boxes and specifically to an adjustable mounting assembly for mounting a fan or light fixture to a cathedral ceiling.

BACKGROUND OF THE INVENTION

Builders or homeowners frequently hang electrical devices, such as fans or lighting fixtures, from cathedral ceilings. Typically the electrical devices are hung from the rafters that support the cathedral ceiling.

Several devices have been proposed for installing electrical devices on cathedral ceilings. For example, U.S. Pat. Nos. 5,592,788 and 5,806,269 to Corridon and U.S. Pat. No. 5,503,359 to Patterson propose various devices for mounting electrical devices on cathedral ceilings. Corridon's mounting system includes a cathedral ceiling fixture mount with a central bore. Screws pass through the mounting plate of the electrical device and through the central bore to engage a standard ceiling workbox. Patterson's mounting box is simply a covering device that obscures the 2×4 studs that are mounted between adjacent ceiling rafters for supporting the electrical device.

Unfortunately, all of the aforementioned prior art mounting devices require the installation of a separate device, such as a workbox or studs, to support the mounting box. Additionally, use of the prior art mounting devices limits the choice of location for hanging an electrical device, as the workbox of Corridon's mounting system must be secured to a rafter unless a support structure such as studs are installed between the rafters.

Prior art mounting devices therefore exhibit several limitations in for the installation of fans or fixtures on cathedral ceilings.

SUMMARY OF THE INVENTION

The invention is an adjustable mounting assembly for hanging a light fixture, fan, or other electrical device from a cathedral ceiling. The adjustable mounting assembly allows an installer to easily mount an electrical device in any location along the apex of a cathedral ceiling. The adjustable mounting assembly includes a central bracket, adjustable mounting bars, and an arrangement for securing an electrical box to the assembly. All the hardware required for securing the mounting assembly to the rafters and for securing the electrical device thereto is included with the assembly to be easily accessible to the installer.

OBJECTS AND ADVANTAGES

The adjustable mounting assembly of the present invention provides a complete mounting assembly for mounting an electrical device to a cathedral ceiling, including all of the required fastening hardware. All of the installation hardware that is required to complete the task is provided as a part of the mounting assembly.

An additional advantage is that the required fasteners are held securely in the adjustable mounting assembly in temporary storage receptacles. The temporary storage receptacles provide an advantage in that the fasteners are held securely in the assembly until they are ready to be used. The required fastening hardware is therefore on hand for installation at the time it is required. By freeing up an installer's hands, the task of mounting an electrical device to a ceiling is therefore greatly simplified and the installation time greatly reduced. Additionally, by having all of the required fastening hardware on hand, the installer is not burdened by the task of locating appropriate fasteners at the appropriate time.

The adjustable mounting assembly also provides the advantage that the entire load of the electrical device is supported by the mounting assembly, and not by the electrical box itself.

The adjustable mounting assembly enables easy adjustments to the location of the supported electrical device, as the electrical device can be easily adjusted to any position between the adjacent rafters it is secured to.

As a further advantage, the adjustable mounting assembly eliminates the need for installing a standard workbox or supporting studs. No workbox or studs are required for installation of the adjustable mounting assembly of the present invention.

These and other objects and advantages of the present invention will be better understood by reading the following description along with reference to the drawings.

Table of Nomenclature

Figure 1:
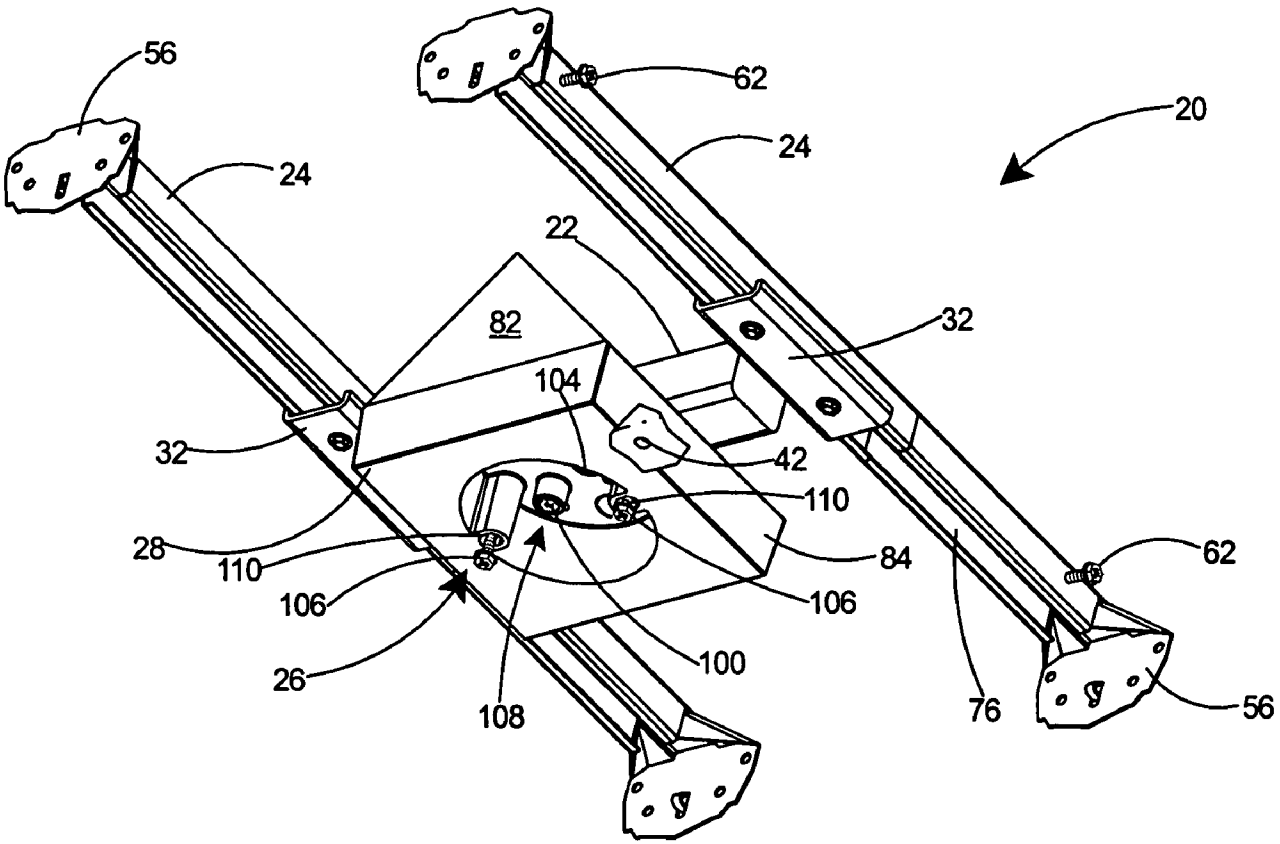
FIG. 1 is a perspective view of a preferred embodiment of an adjustable mounting assembly according to the present invention.

27) The following is a listing of part numbers used in the drawings along with a brief description:

| Part Number | Description |
|---|---|
| 20 | adjustable mounting assembly |
| 22 | mounting bracket |
| 24 | adjustable mounting bars |
| 26 | securing arrangement |
| 28 | electrical box |
| 30 | center bar |
| 32 | end portion |
| 34 | U-shaped cross section of mounting bracket |
| 36 | bottom portion of U-shaped cross section |
| 38 | first plane |
| 40 | second plane |
| 42 | bore in mounting bracket |
| 44 | U-shaped top |
| 46 | aperture in end portion |
| 48 | outer tubular member |
| 50 | inner tubular member |
| 52 | inner end |
| 54 | outer end |
| 56 | flange |
| 58 | aperture in flange |
| 60 | temporary storage receptacle in tubular member |
| 62 | bar fastener |
| 64 | integral nail |
| 66 | inward bent portion |
| 68 | sharpened point |
| 70 | locking arrangement |
| 72 | bottom side of tubular member |
| 76 | elongated slot |
| 78 | slide member |
| 80 | fastener |
| 82 | longitudinal wall of electrical box |
| 84 | lateral wall of electrical box |
| 86 | inverted V-shaped top edge |
| 88 | level top edge |
| 90 | first set of sidewalls |
| 92 | second set of sidewalls |
| 94 | top wall of electrical box |
| 96 | inner cavity |
| 98 | knockout |
| 100 | box fastener |
| 102 | boss |
| 104 | fastener storage receptacle |
| 106 | load bearing fastener |
| 108 | box fastening arrangement |
| 110 | opening |
| 112 | blank |
| 114 | bend line |
| 116 | rafter |
| 118 | rafter |
| 120 | mounting plate |
| 122 | electrical fixture |
| 124 | aperture in mounting plate |
| 126 | sheetrock |

DETAILED DESCRIPTION OF THE INVENTION

The invention is an adjustable mounting assembly for securing an electrical device, such as a fan or a fixture, to a cathedral ceiling.

With reference to FIG. 1, a preferred embodiment is shown of an adjustable mounting assembly 20 including a mounting bracket 22, adjustable mounting bars 24, an electrical box 28, and a securing arrangement 26 for securing an electrical device such as a fan or fixture (not shown) to the adjustable mounting assembly 20.

Figure 2:
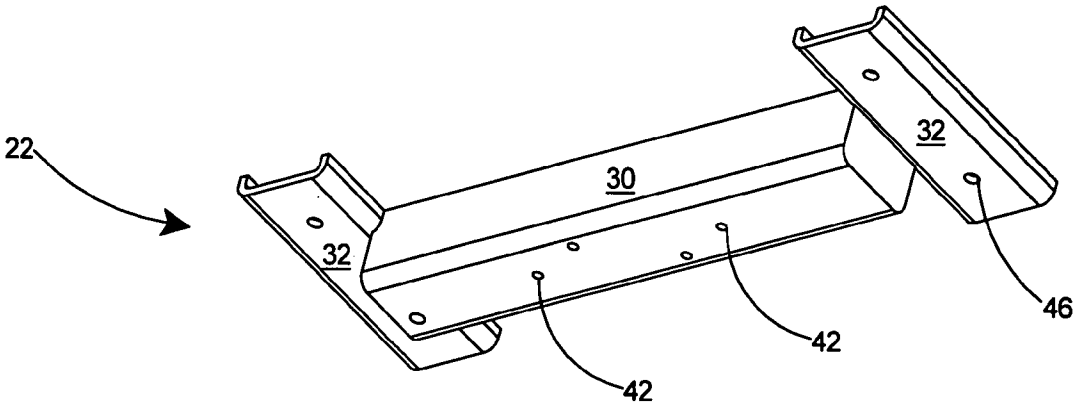
FIG. 2 is a perspective view of a mounting bracket that comprises a portion of the adjustable mounting assembly of FIG. 1.

As shown in FIG. 2, the mounting bracket 22 includes a center bar 30 and two end portions 32.

Figure 5:
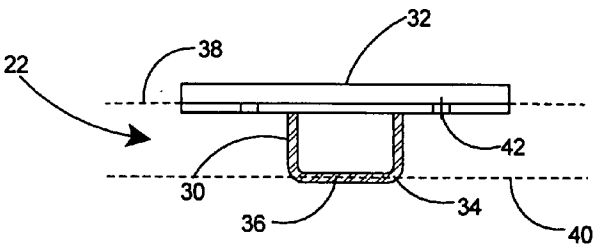
FIG. 5 is a sectional view of the mounting bracket taken along line 5—5 of FIG. 3.

Referring to FIG. 5, the center bar 30 of the mounting bracket 22 includes a substantially U-shaped cross section 34. The U-shaped center bar 30 includes a bottom portion 36. The end portions 32 of the mounting bracket 22 are in a first plane 38 and the bottom portion 36 is in a second plane 40. This arrangement, with the bottom portion 36 in a lower plane 40 than the first plane 38 of the end portions 32, will enable easy positioning of the later installed electrical device (not shown) with respect to the ceiling covering, such as sheet rock, for those installations in which the ceiling rafters are covered.

Figure 3:
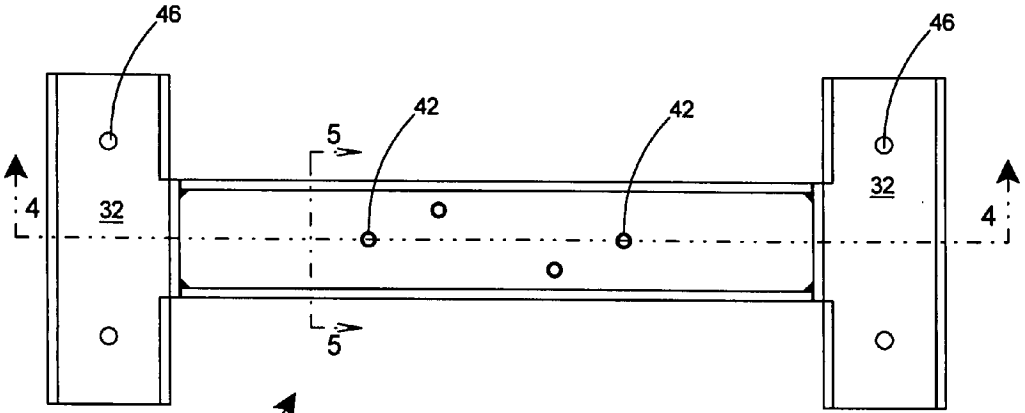
FIG. 3 is a top view of the mounting bracket of FIG. 2.
Figure 4:
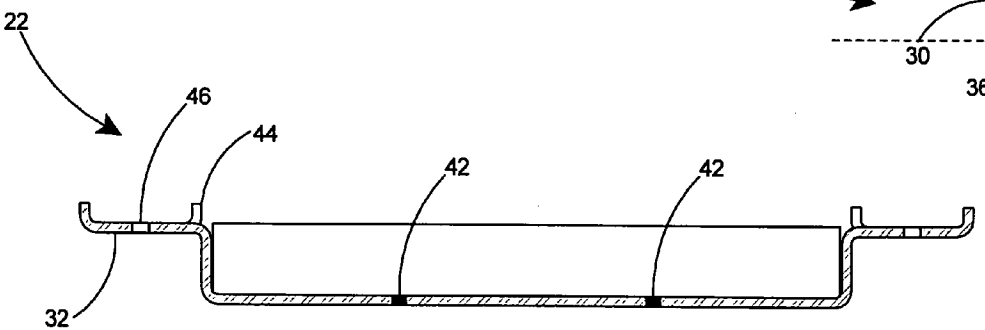
FIG. 4 is a sectional view of the mounting bracket taken along line 4—4 of FIG. 3.

As shown in FIGS. 3 and 4, one or more bores 42 are included therein in the mounting bracket 22. The end portions 32 of the mounting bracket 22 include U-shaped tops 44 and apertures 46 therein.

Figure 7:
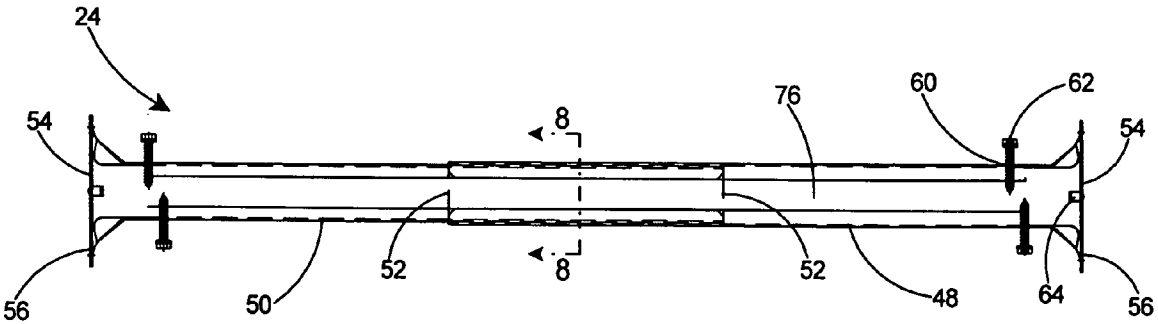
FIG. 7 is a bottom view of an adjustable mounting bar that comprises a portion of the adjustable mounting assembly of FIG. 1.
Figure 8:
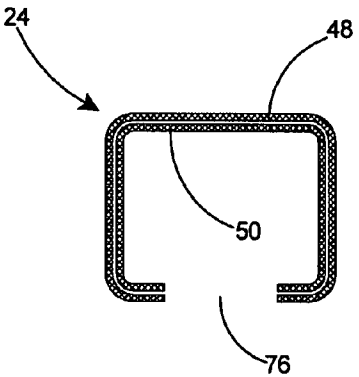
FIG. 8 is a sectional view of the adjustable mounting bar taken along line 8—8 of FIG. 7.

With reference to FIG. 7, the adjustable mounting bars 24 include an outer tubular member 48 and an inner tubular member 50. Each tubular member 48 and 50 includes an inner end 52 and an outer end 54. At their inner ends 52, the inner tubular member 50 is received within the outer tubular member 48, thereby making the inner tubular member 50 slideable with respect to the outer tubular member 48. At the cross section shown in FIG. 8, the inner tubular member 50 is disposed within the outer tubular member 48 and the adjustable mounting bars 24 are therefore capable of being adjusted in length.

With further reference to FIG. 7, a flange 56 is included on the outer end 54 of each of the tubular members 48 and 50. The flanges 56 are substantially orthogonal to the elongated tubular members 48 and 50. The flanges 56, as shown in FIG. 7A, further include apertures 58 therein.

The tubular members 48 and 50 further include temporary storage receptacles 60 proximate their outer ends 54 and one or more bar fastener 62 secured therein. The temporary storage receptacles 60 provide a temporary storage location for the bar fasteners 62 thereby making them easily accessible to an installer at the time that they will be needed. When securing the adjustable mounting assembly to two adjacent rafters in a cathedral ceiling, the bar fasteners 62 are removed from the temporary storage receptacles 60 and inserted through the apertures 58 in the flanges 56.

Figure 7B:
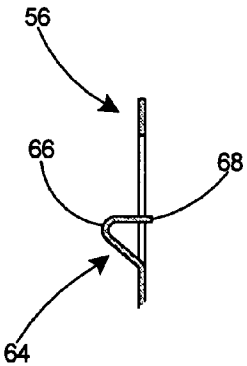
FIG. 7B is a sectional view of the flange portion taken along line 7B—7B of FIG. 7A.
Figure 7A:
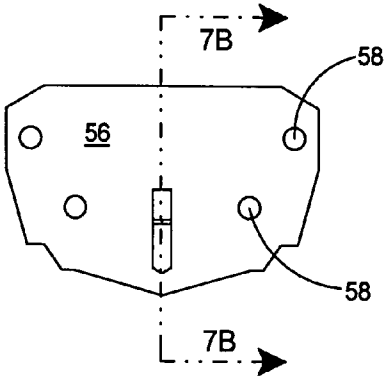
FIG. 7A is a view of the flange portion of the adjustable mounting bar taken along line 7A—7A of FIG. 7.

As shown in FIG. 7B, the flanges 56 further include an integral nail 64. The integral nail 64 includes an inward bent portion 66 of the flange 56 and an outward facing sharpened point 68 enabling the tubular members 48 and 50 to be initially secured to the rafters by hammering the nails into the rafters (not shown).

Figure 16:
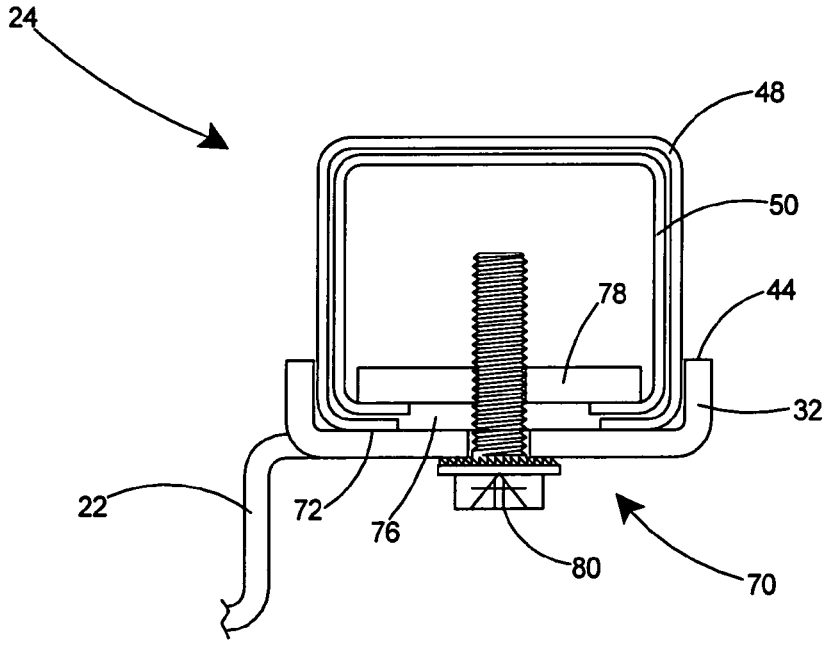
FIG. 16 is a sectional view of the adjustable mounting assembly taken along line 16—16 of FIG. 15.

Referring to FIG. 16, the adjustable mounting bars 24 further include a locking arrangement 70 for locking the length of the adjustable mounting bars to a desired length. The tubular members 48 and 50 each include a bottom side 72. The bottom side 72 of the tubular members 48 and 50 are received within the U-shaped top 44 of the end portions 32. The locking arrangement 70 includes an elongated slot 76 on the bottom side 72 of each of the tubular members 48 and 50, a slide member 78 disposed within the tubular members, and a fastener 80 disposed through the end portions 32 of the mounting bracket 22, thence through the elongated slots 76, and into the slide member 78. The fastener 80 in a loosened state enables the mounting bracket 22 to slide with respect to the tubular members 48 and 50 and the fastener 80 in a tightened state locks the mounting bracket 22 with respect to the tubular members 48 and 50.

Figure 9:
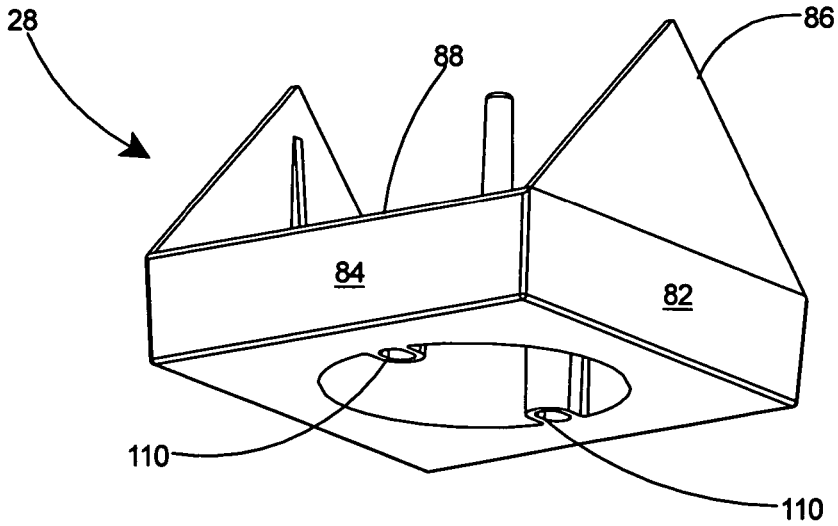
FIG. 9 is a perspective view of an electrical box that comprises a portion of the adjustable mounting assembly of FIG. 1.
Figure 10:
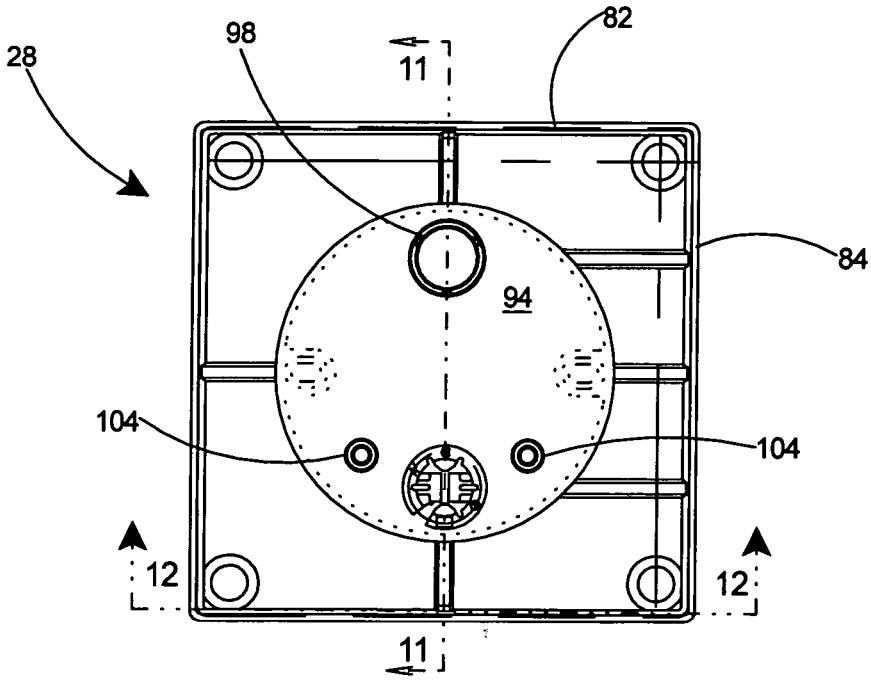
FIG. 10 is a top view of the electrical box of FIG. 9.
Figure 11:
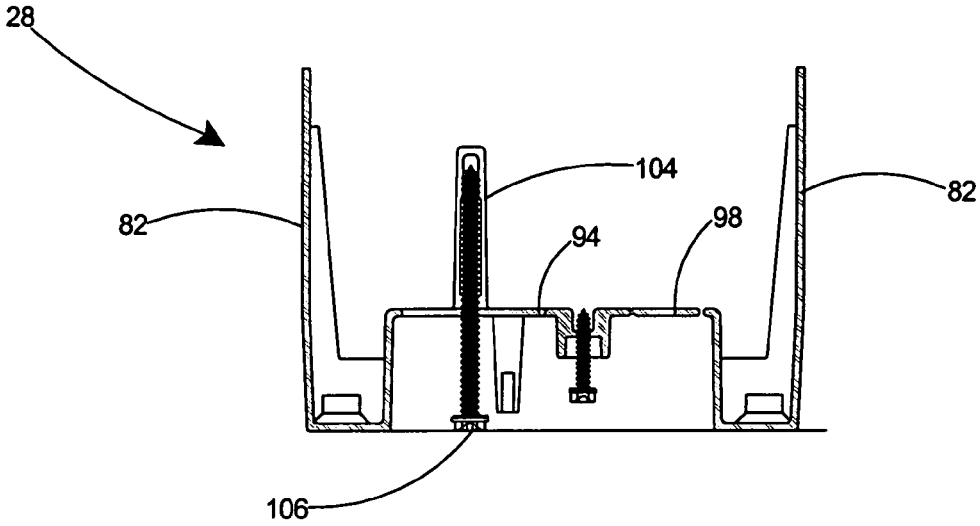
FIG. 11 is a sectional view of the electrical box taken along line 11—11 of FIG. 10.
Figure 12:
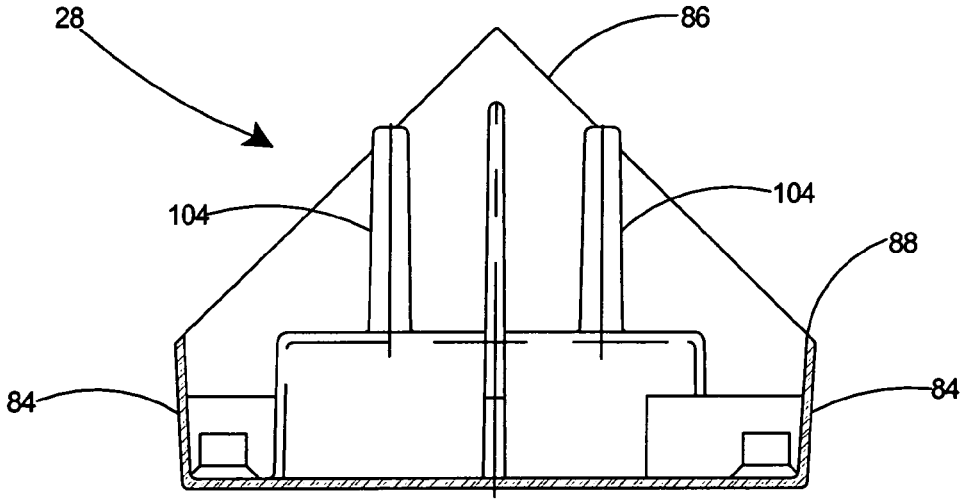
FIG. 12 is a sectional view of the electrical box taken along line 12—12 of FIG. 10.

FIG. 9 depicts the preferred embodiment of an electrical box 28 for use with the adjustable mounting assembly 20 of the present invention. The electrical box 28 includes four outer sidewalls 82 and 84, including longitudinal walls 82 and lateral walls 84. The longitudinal walls 82 include an inverted V-shaped top edge 86 and the lateral walls 84 include a level top edge 88.

Figure 14:
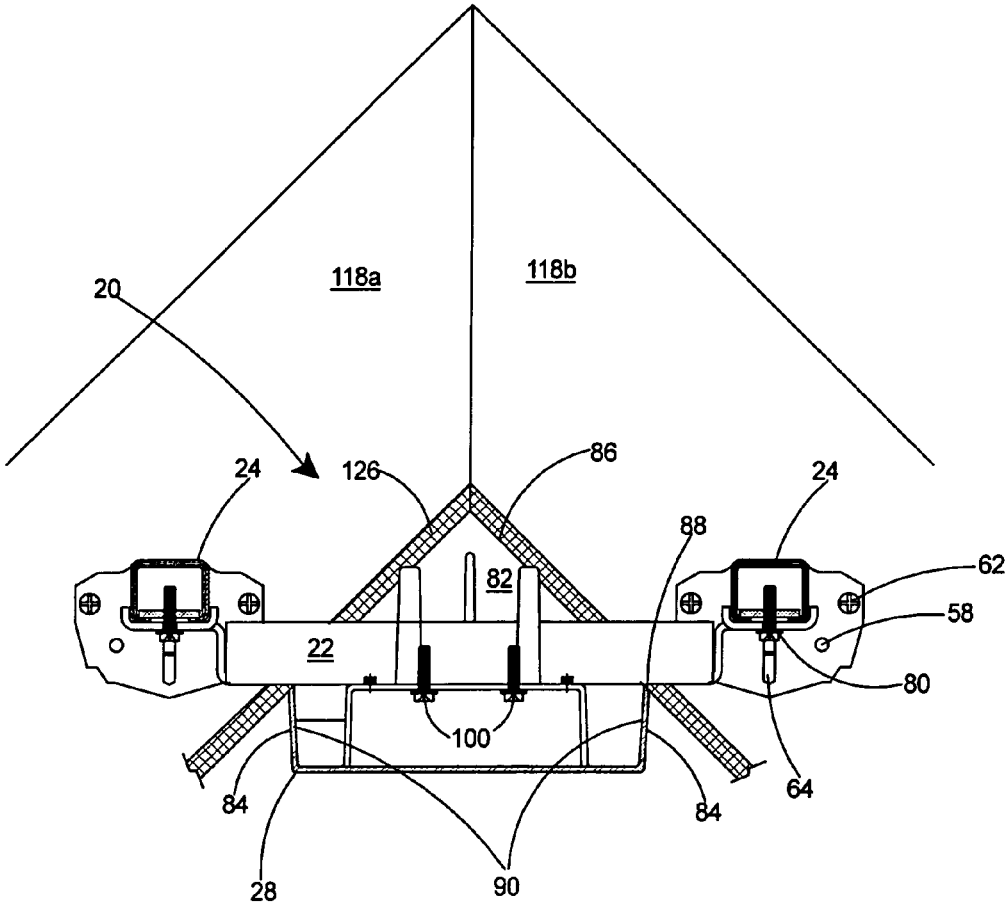
FIG. 14 is a conceptual sectional view depicting one end of the adjustable mounting assembly secured to a rafter.
Figure 15:
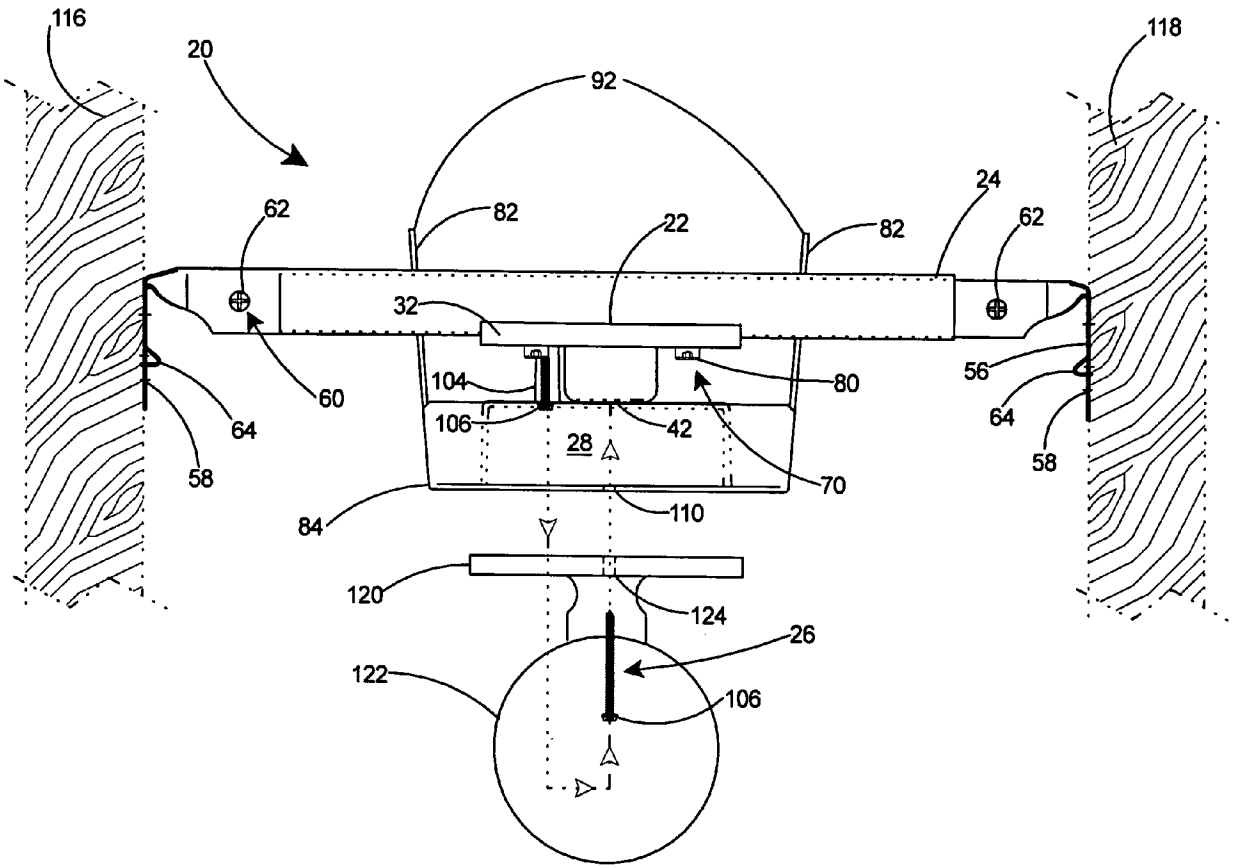
FIG. 15 is a side view depicting the adjustable mounting assembly secured to two adjacent rafters.

With reference to FIG. 14, the lateral walls 84 comprise a first set 90 of outer sidewalls, which are parallel to the adjustable mounting bars 24. As shown in FIG. 15, the longitudinal walls 82 comprise a second set 92 of outer sidewalls, which are orthogonal to the adjustable mounting bars 24.

Figure 13:
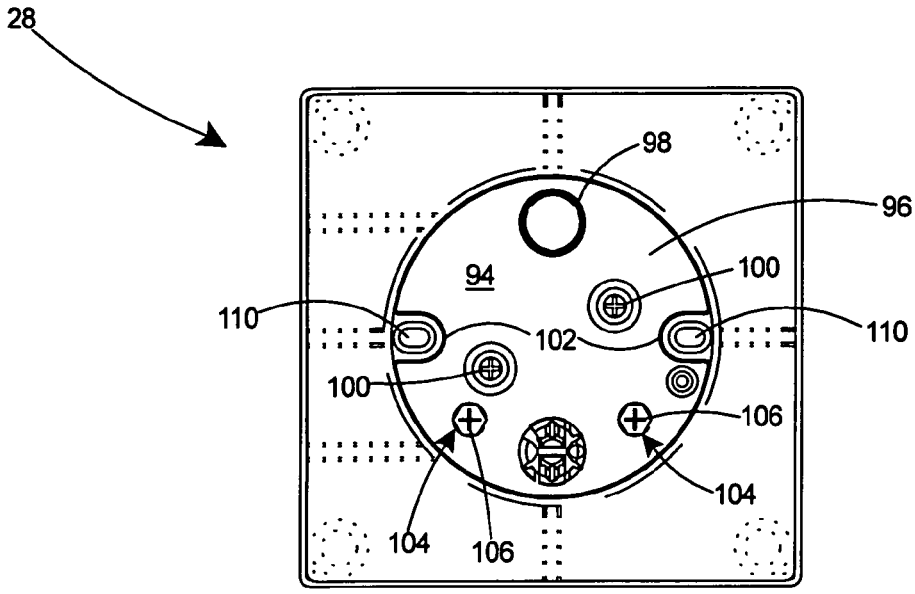
FIG. 13 is a bottom view of the electrical box of FIG. 9.

With reference to FIG. 13, the electrical box 28 includes a top wall 94, an inner cavity 96, knockouts 98, and box fasteners 100 held within bosses 102 extending into the inner cavity 96 from the top wall 94. Fastener storage receptacles 104 are provided extending upwards from the top wall 94 and includes load bearing fasteners 106 frictionally held therein. The fastener storage receptacles 104 provide temporary storage of the load bearing fasteners 106 until they are removed therefrom and used to secure the electrical box 28 to the adjustable mounting assembly 20. Openings 110 are also provide in the top wall 94.

With reference to FIG. 1, the adjustable mounting assembly 20 further includes a box fastening arrangement 108 for securing the electrical box 28 to the mounting assembly 20. The box fasteners 100 secure the electrical box 28 to the mounting bracket 22 and align the openings 110 with the bores 42 in the mounting bracket 22.

The securing arrangement 26 includes the openings 110 in the electrical box 28 that are capable of being axially aligned with the bores 42, visible behind the cutaway portion of the electrical box 28, in the mounting bracket 22. The securing arrangement 26 further includes the load bearing fasteners 106 which have an outer diameter smaller than the openings 110 in the electrical box 28. To secure an electrical device (not shown) to the adjustable mounting assembly 20 using the securing arrangement 26, the each load bearing fastener 106 is removed from the fastener storage receptacles 104 and then passed through the opening 110 in the electrical box 28 and tightened into the respective bores 42 in the mounting bracket 22 to secure the electrical box 28 thereto.

Figure 6:
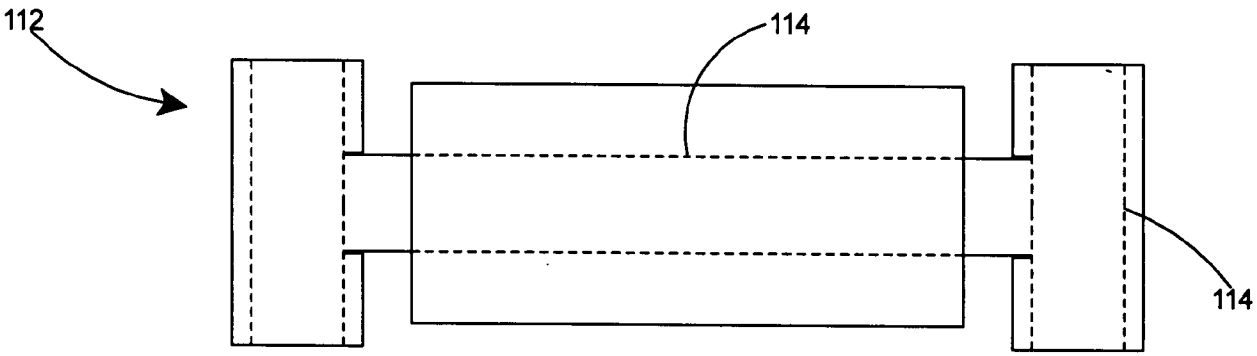
FIG. 6 is a plan view of a blank that will be formed into the mounting bracket of FIG. 2.

The mounting bracket 22 of the present invention is preferably constructed of metal, such as steel. The mounting bracket 22 may be constructed from a flat metal blank 112 such as that shown in FIG. 6. The dashed lines represent bend lines 114 along which the flat metal blank is bent to form the mounting bracket of FIG. 2.

The tubular members 48 and 50 that form the adjustable mounting bars 24 of the present invention are also preferably constructed of metal. The mounting bracket and adjustable mounting bars, being constructed of metal, are therefore capable of supporting the heavy load of a ceiling fan or electrical fixture, which may weigh up to 80 pounds.

The electrical box 28 shown in FIG. 9 may be molded of plastic in one piece or may be constructed of metal. Although a specific embodiment of an electrical box is shown herein for use with the adjustable mounting assembly, it should be understood that a wide range of electrical boxes could be used with the mounting assembly. Since the electrical box does not support the load of the fan or fixture, many standard electrical boxes would be acceptable, as long as apertures were provided in the electrical box at the same spacing as the bores in the mounting bracket, thereby allowing axial alignment of the apertures in the electrical box with the bores in the mounting bracket.

The reader is referred to FIG. 15 for an understanding of the operation of the adjustable mounting assembly 20 of the present invention. The adjustable mounting assembly 20 is first located, as shown in FIG. 15, between two adjacent sets of rafters 116 and 118 at which it is desired to hang a fan or fixture 122. The length of the adjustable mounting bars 24 are then set to the proper length to span between the rafters 116 and 118 and the fasteners 80 of the locking arrangement 70 tightened to lock the adjustable mounting bars 24 to the desired length. The adjustable mounting assembly 20 is leveled and the integral nails 64 on each end of the adjustable bars 24 are hammered into the rafters 116 and 118 to temporarily hold the mounting assembly 20 in place. The bar fasteners 62 are then removed from the temporary storage receptacles 60 and driven through the apertures 58 in the flange 56 and into the rafters 116 and 118 to permanently secure the adjustable mounting assembly 20 to the rafters.

At this point the adjustable mounting assembly 20 is securely mounted to the rafters 116 and 118 and the electrical box 28 is fixed with respect to the adjustable mounting bars 24 by the tightened locking arrangement 70. If any adjustments are required in the position of the electrical box 28 with respect to the mounting assembly 20, the locking arrangement 70 can easily be unlocked by loosening fasteners 80. The mounting bracket 22 and the electrical box 28 can then be slid to the newly desired position and the locking arrangement 70 retightened to lock it into place.

With the electrical box 28 secured to the mounting assembly and the mounting assembly 20 secured to the rafters 116 and 118, the securing arrangement 26 can then be used to secure an electrical fan or fixture to the electrical box 28 and mounting assembly 20. The load bearing fasteners 106, one of which is visible in FIG. 15, are removed from the fastener storage receptacles 104 within the inner cavity of the electrical box 28. The mounting plate 120 of the electrical fixture 122 is then placed in close proximity to the electrical box 28 and the apertures 124 of the mounting plate 120 aligned axially with the openings 110 of the electrical box 28 which in turn are in alignment with the bores 42 in the mounting bracket 22. The bores 42 in the mounting bracket 22 preferably include threads to match the threads of the load bearing fasteners 106. The load bearing fasteners 106 are then tightened into the bores 42 of the mounting bracket 22 to secure the electrical fixture 122 to the adjustable mounting assembly 20. The dashed lines with arrows in the figure signify the path of one of the load bearing fasteners 106, which are removed from the fastener storage receptacles 104 and placed through the apertures 124 in the mounting plate 120 of the electrical fixture 122 and into the bores 42 in the mounting bracket 22.

As shown in FIG. 14, the inverted V-shaped top edges 86 of the longitudinal walls 82 provide an attractive fan or fixture mount for a covered ceiling. If sheetrock 126 or other wall covering material is attached to the rafters 118*a* and 118*b*, the adjustable mounting assembly 20 can be secured to the rafters at a height to bring the V-shaped top edges 86 of the longitudinal walls 82 and the level top edges 88 of the lateral walls 84 flush with the bottom surface of the sheetrock 126. This makes for an attractive fan or fixture mount and eliminates any gaps between the ceiling and the electrical box 28.

With reference to FIG. 15, a distinct advantage of the adjustable mounting assembly 20 is that it can be moved if desired. If, for example, a homeowner wished to change the location of the fan or fixture, the bar fasteners 62 would be removed and the locking arrangement 70 loosened to permit a reduction in length of the adjustable mounting bars 24. With the adjustable mounting bars 24 reduced in length, the adjustable mounting assembly 20 could be moved to a new location. The electrical wiring connections would of course need to be removed and then reattached at the new location.

Having thus described the invention with reference to a preferred embodiment, it is to be understood that the invention is not so limited by the description herein but is defined as follows by the appended claims.

What is claimed is:

1. An adjustable mounting assembly for securing an electrical device to rafters of a cathedral ceiling comprising:

a mounting bracket including a center bar having two end portions;

said center bar of said mounting bracket including a substantially U-shaped cross section;

an adjustable mounting bar on each of said end portions of said mounting bracket, said adjustable mounting bars capable of being adjusted in length; and a securing arrangement enabling said electrical device to be secured to said mounting bracket.

2. The adjustable mounting assembly of claim 1 wherein said adjustable mounting bar includes:

an outer tubular member having an inner end and an outer end;

an inner tubular member having an inner end and an outer end; and said inner tubular member disposed within said outer tubular member such that said inner tubular member is slideable with respect to said outer tubular member.

3. The adjustable mounting assembly of claim 2 including a flange on said outer end of each of said tubular members.

4. The adjustable mounting assembly of claim 3 wherein said flange on said outer ends of said tubular members are substantially orthogonal thereto.

5. The adjustable mounting assembly of claim 3 including an aperture in said flanges.

6. The adjustable mounting assembly of claim 3 including an integral nail on said flange of said tubular member, said nail including an inward bent portion of said flange and an outward facing sharpened point enabling said tubular members to be initially secured to said rafters by hammering said nails into said rafters.

7. The adjustable mounting assembly of claim 1 wherein said end portions of said mounting bracket are in a first plane;

said U-shaped center bar includes a bottom portion in a second plane; and said second plane is lower than said first plane.

8. The adjustable mounting assembly of claim 1 wherein said securing arrangement includes an electrical box;

a bore in said mounting bracket;

an opening in said electrical box axially aligned with said bore in said mounting bracket; and a fastener having an outer diameter smaller than said opening in said electrical box;

whereby said fastener is passed through said opening in said electrical box and tightened into said bore in said mounting bracket to secure said electrical device to said adjustable mounting assembly.

9. The adjustable mounting assembly of claim 8 including fastener storage receptacles in said electrical box;

whereby said fastener storage receptacles provide temporary storage of said fasteners until said fasteners are used to secure said electrical device to said adjustable mounting assembly.

10. The adjustable mounting assembly of claim 8 wherein said electrical box includes four outer sidewalls;

a first set of said outer sidewalls are parallel to said adjustable mounting bars;

a second set of said outer sidewalls are orthogonal to said adjustable mounting bars;

said first set of outer sidewalls include a level top edge; and said second set of outer sidewalls include an inverted V-shaped top edge.

11. The adjustable mounting assembly of claim 8 wherein said electrical box is molded in one piece of plastic.

12. The adjustable mounting assembly of claim 1 including a locking arrangement for locking the length of said adjustable mounting bars to a desired length.

13. An adjustable mounting assembly for securing an electrical device to rafters of a cathedral ceiling comprising:

a mounting bracket including two end portions;

an adjustable mounting bar on each of said end portions of said mounting bracket, said adjustable mounting bar including an inner tubular member and an outer tubular member, said inner tubular member slidable within said outer tubular member for adjusting the length of said adjustable mounting bar;

a securing arrangement enabling said electrical device to be secured to said mounting bracket;

a locking arrangement for locking the length of said adjustable mounting bars to a desired length; and said locking arrangement includes an elongated slot on said tubular members;

a slide member disposed within said tubular members; and a fastener disposed through said elongated slot and connecting said end portions of said mounting bracket with said slide member;

whereby said fastener in a loosened state enables said mounting bracket to slide with respect to said tubular members and said fastener in a tightened state locks said mounting bracket with respect to said slide member.

14. The adjustable mounting assembly of claim 13 wherein said tubular members include a bottom side; and said elongated slot is on said bottom side of said tubular members.

15. The adjustable mounting assembly of claim 14 wherein said end portions of said mounting bracket include a U-shaped top; and said bottom side of said tubular members are received within said U-shaped top of said end portions.

16. An adjustable mounting assembly for securing an electrical device to rafters of a cathedral ceiling comprising:

a mounting bracket including two end portions;

an adjustable mounting bar on each of said end portions of said mounting bracket, said adjustable mounting bars capable of being adjusted in length;

a securing arrangement enabling said electrical device to be secured to said mounting bracket said adjustable mounting bar including an inner tubular member and an outer tubular member;

a flange on said inner and outer tubular members, said flange including an aperture therein;

a temporary storage receptacle in said inner and outer tubular members; and a bar fastener secured in said temporary storage receptacle;

wherein said bar fastener is removed from said temporary storage receptacle and inserted through said aperture to secure said adjustable mounting assembly to said rafters.

* * * * *